US007452010B2

(12) United States Patent
Cotton

(10) Patent No.: US 7,452,010 B2
(45) Date of Patent: Nov. 18, 2008

(54) D-HANDLE LATCH FOR BOAT HATCHES

(76) Inventor: Oren Cotton, P.O. Box 729, East Sound, WA (US) 98245

( * ) Notice: Subject to any disclaimer, the term of this patent is extended or adjusted under 35 U.S.C. 154(b) by 66 days.

(21) Appl. No.: 11/281,552

(22) Filed: Nov. 17, 2005

(65) Prior Publication Data

US 2007/0120374 A1 May 31, 2007

(51) Int. Cl.
*E05C 5/00* (2006.01)
*E05C 19/10* (2006.01)

(52) U.S. Cl. ..... 292/66; 292/69; 292/100; 292/126; 292/200; 292/336.3; 292/DIG. 31

(58) Field of Classification Search ..... 292/66, 292/69, 100, DIG. 31, 126, 200, DIG. 61, 292/63–65, 67, 336.3, DIG. 60, DIG. 63, 292/108; 70/208, 201, 210, 224, 432
See application file for complete search history.

(56) References Cited

U.S. PATENT DOCUMENTS 1,193,148 A * 8/1916 Hornung ..... 292/57
1,905,220 A * 4/1933 De Orlow ..... 292/66
2,772,809 A * 12/1956 Ross ..... 220/318
3,021,165 A 2/1962 Hamilton et al.
3,089,330 A * 5/1963 Kerr ..... 70/140
3,302,964 A 2/1967 Barry
4,370,874 A * 2/1983 Munn ..... 70/204
4,377,243 A * 3/1983 Shaw et al. ..... 220/210
4,556,244 A 12/1985 Bisbing
4,706,478 A 11/1987 Swan et al.
4,763,935 A 8/1988 Bisbing
4,898,408 A * 2/1990 Hauber ..... 292/7
D328,231 S 7/1992 Hansen
D370,620 S 6/1996 Ziemer
5,913,908 A * 6/1999 Czipri ..... 70/208
6,418,761 B1 * 7/2002 Wytcherley et al. ..... 70/208
6,474,119 B1 * 11/2002 Halvorson et al. ..... 70/208
6,516,643 B1 * 2/2003 Olshausen ..... 70/337
6,578,884 B2 * 6/2003 Chiang ..... 292/66
6,626,472 B1 * 9/2003 Berg ..... 292/336.3
D489,959 S 5/2004 Jackson et al.

(Continued)

OTHER PUBLICATIONS

Perko, Inc. 2005 Marine Hardware Catalog, p. 198, 202, 203, 206.

*Primary Examiner*—Patricia Engle
*Assistant Examiner*—Alyson M Merlino

(57) ABSTRACT

A latch for use with a boat hatch including a housing having a well, a floor, and a flange mounted against the boat hatch. The housing has a boss with a bushing and a vertical bore. A slot extends transversely through the boss and the vertical bore. A pull shaft with an annular O-ring is mounted in the bushing bore. A rotation stop pin on the pull shaft will contact the slot, limiting the rotation to one-half turn. A latch bar projects outward from the pull shaft lower end. A D-shaped handle is pivotally mounted on the pull shaft upper end. A spring is disposed below the rotation stop, to bias the pull shaft downward. A lock shaft is mounted for rotation in the housing. A hook with a finger is attached to the lock shaft. A key rotates the hook into engagement with the second pin. The second pin, enclosed between the finger and the boss slot, prevents rotation of the pull shaft and unlatching of the latch.

15 Claims, 4 Drawing Sheets

U.S. PATENT DOCUMENTS

| | | | | |
|---|---|---|---|---|
| 6,953,209 | B2 | 10/2005 | Jackson et al. | |
| 2004/0056488 | A1* | 3/2004 | Jackson et al. | 292/66 |
| 2004/0183312 | A1* | 9/2004 | Magnusson | 292/95 |
| 2005/0144993 | A1* | 7/2005 | Antonucci et al. | 70/208 |
| 2005/0151378 | A1* | 7/2005 | Magnusson et al. | 292/165 |

* cited by examiner

D-HANDLE LATCH FOR BOAT HATCHES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of door latches and handles, and more particularly to a latch with a D-shaped handle or pull having a camover action, for use with a boat hatch having a compression seal.

Boat hatches require secure latching so as not to leak or open up, especially when underway in foul weather. Further, some locking means is desirable when in port or unattended, for security against break-in. One popular style of hatch pull utilizes a T-handle or a D-handle for grasping, and a latch bar to engage the hatch jamb. The handle has a cam lobe shaped pivotal attachment to a shaft. The D-handle is set into a pocket in a housing that is mounted flush with the hatch. As the D-handle is pivoted downward into the pocket, the cam pulls the shaft and latch bar upward against the hatch jamb, compressing a gasket around the hatch. This camover action secures the hatch against opening and against leaking. A compression spring biases the shaft downward so as to release the latch bar as the handle is raised. Rotating the handle will pivot the latch bar away from the hatch jamb, to open the hatch. A rotation stop positions the latch bar underneath the hatch jamb. The spring is usually mounted above the rotation stop, inside a lower boss on the housing. This position makes it difficult to inspect, lubricate, or replace the spring.

Hatch handles or pulls have taken a variety of configurations in the past. The following are some examples of hatch pulls in the prior art.

Jackson, U.S. Pat. No. D 489,959, and Jackson, U.S. Pat. No. 6,953,209, each shows a D-handle hatch pull, but without any lock feature. A compression spring is mounted above the rotation stop.

Hornung, U.S. Pat. No. 1,193,148, shows a D-handle 30 pulling a draw bar 13. The latch bar arm 6 engages the hatch jamb, and opposite latch bar arm 10 hits stops 41 and 42 to limit rotation to 90 degrees. A compression spring 19 pushes against the bottom wall 20 above the rotation stop.

Perko catalog 2005, pgs. 202 & 203, shows latches with D-handles that fold down flush. Position indicators show the open or closed position, but are difficult to see. These are not compression latches, as there is no cam or spring.

Bisbing, U.S. Pat. No. 4,556,244, illustrates a compression latch T-handle with a pin engaging a cross-slot rotation stop for 90-degree rotation. A second pin rides in helical slots in a sleeve to provide axial pull as the handle is rotated. The handle has no cam and does not fold down. A compression spring is mounted above the rotation stop.

Perko catalog 2005, pg. 206, FIG. 0777, shows a compression latch with a T-handle that folds down. The compression spring is above the rotation stop.

Bisbing, U.S. Pat. No. 4,763,935, utilizes a lift-up lever handle pulling a draw bar and latch bar. The handle does not fold down flush, or fold down in the open position. A pin enters a cross-slot rotation stop. The compression spring is above the rotation stop.

Accordingly, there is a need to provide a boat hatch D-handle latch that can fold down flush with the housing in both the open and closed positions.

There is a further need to provide a boat hatch D-handle latch of the type described and that includes a position indicator showing clearly both the open and closed positions.

There is a yet further need to provide a boat hatch D-handle latch of the type described and that has a rotation stop that positions the latch bar underneath the hatch jamb.

There is a still further need to provide a boat hatch D-handle latch of the type described and wherein the compression spring is mounted beneath the rotation stop, to facilitate easy inspection, lubrication, or replacement of the spring without removing the handle or shaft.

There is another need to provide a boat hatch D-handle latch of the type described and which has a lock to secure the latch in the closed position.

There is yet another need to provide a boat hatch D-handle latch of the type described and that can be manufactured cost-effectively in large quantities of high quality.

BRIEF SUMMARY OF THE INVENTION

In accordance with the present invention, there is provided a latch for use in connection with a boat hatch having a compression seal and a hatch jamb. The latch comprises a housing having a well extending between opposite upper and lower ends. The well has a floor enclosing the lower end. The housing has a flange extending outward from the well upper end. The flange has a top surface and a bottom surface, with the bottom surface being adapted for mounting against the boat hatch. The housing has a pocket extending downward from the floor. The housing has a boss extending downward from the floor, with a vertical bore through the boss.

A pull shaft extends between opposite upper and lower ends, and has a longitudinal axis. The pull shaft has a first hole transversely through it adjacent the pull shaft upper end. The pull shaft has a second hole transversely through it below the first hole, the second hole being juxtaposed with the slot. The pull shaft has a third hole transversely through it below the second hole. The pull shaft is mounted in the vertical bore for rotational movement and sliding movement along the vertical central axis between an upper position and a lower position.

A handle is provided, which has a grasping portion and two ears extending outward from the grasping portion. The ears have collinear pivot holes transversely through them. The handle is pivotally mounted on the pull shaft with the ears straddling the pull shaft upper end and the pivot holes aligned with the pull shaft first hole. This allows pivotal movement from a handle position projecting upward to a handle position lying within the well. The ears each have a cam lobe shape, so as to cause the pull shaft to slide axially in the vertical bore as the handle is raised and lowered. The handle has a dimple with a brightly colored pigment therein. The dimple is visible when the handle is lying within the well and the latch bar is in the unlatched position. This will clearly indicate, by visual inspection, that the latch in the unlatched position.

A first pin is received in the pivot holes and the pull shaft first hole. The first pin will pivotally mount the handle to the pull shaft upper end.

A second pin is received in the pull shaft second hole. The second pin projects outward on only one side of the pull shaft.

The boss has a slot extending transversely through the boss and through the vertical bore. The slot extends vertically along the central axis from an upper terminal surface to a lower terminal surface. The lower terminal surface is above the boss distal end. The upper and lower terminal surfaces are generally planar and generally perpendicular to the central axis. The upper terminal surface faces downward, and the lower terminal surface faces upward. The slot is juxtaposed with the second hole. The distance between the upper terminal surface and the lower terminal surface is sufficient to allow the second pin to travel within the slot between the upper position and the lower position. The slot has a slot wall extending generally vertically between the upper terminal surface and the lower terminal surface. The slot has a transverse depth extending from the boss periphery inward past the central axis to the slot wall. The transverse depth is sufficient to allow the second pin to rotate one half turn before striking the slot wall in either direction, thereby defining a rotation stop. The second pin will contact the slot wall at the predetermined rotational position and at a second rotational position approximately one-half turn from the predetermined rotational position. This contact will stop the latch bar in the latched and unlatched positions, respectively.

A third pin is received in the pull shaft third hole. The third pin projects outward on both sides of the pull shaft.

A coil spring is mounted generally concentrically on the pull shaft. The spring bears upward on the boss and downward on the third pin. This is to bias the pull shaft downward with respect to the housing. The spring is disposed below the rotation stop. This placement is necessary to allow inspection, lubrication, and replacement of the spring without removing the shaft from the housing.

A latch bar is mounted on the pull shaft lower end and projects transversely outward. The latch bar is adapted for engaging the hatch jamb. Attaching means is provided for attaching the latch bar on the pull shaft lower end. Fastening means is provided for fastening the latch to the boat hatch.

Thus, with the latch bar in an unlatched position, the handle will lie flush with the housing inside the well. The handle will then be pivoted into an upright position, and the cam lobes and spring will cause the pull shaft to slide axially downward to the lower position. The handle will then be rotated one-half turn so that the latch bar engages the hatch jamb in a latched position. The handle will be pivoted downward so that the handle will lie flush with the housing inside the well. As the handle moves, the cam lobes will cause the pull shaft to slide axially upward to the upper position and thereby raise the latch bar so as to increase the compression between the hatch and the seal for watertight closure.

A lock shaft extends between opposite upper and lower ends. The lock shaft is mounted for rotation in the housing floor with the lower end projecting below the housing floor. A hook extends between opposite proximal and distal ends. The hook proximal end is attached to the lock shaft lower end. The hook distal end has a finger projecting transversely outward therefrom. The finger is adapted for engagement with the second pin. The finger is of a predetermined thickness sufficient to maintain engagement with the second pin as the pull shaft slides between the upper position and the lower position.

A key has a handle for grasping, and a stem extending from the handle. The stem is configured to releasably engage the lock shaft upper end so as to transmit rotational motion from the key to the lock shaft. Typically, the lock shaft upper end will have a male spline, and the key a matching female spline.

BRIEF DESCRIPTION OF THE SEVERAL VIEWS OF THE DRAWING

A more complete understanding of the present invention may be obtained from consideration of the following description in conjunction with the drawing, in which:

FIG. 11 is a perspective view of the D-handle latch of FIG. 8, showing the latch unlocked; and FIG. 12 is a perspective view of the D-handle latch of FIG. 8, showing the latch locked.

DETAILED DESCRIPTION OF THE INVENTION

Figure 1:
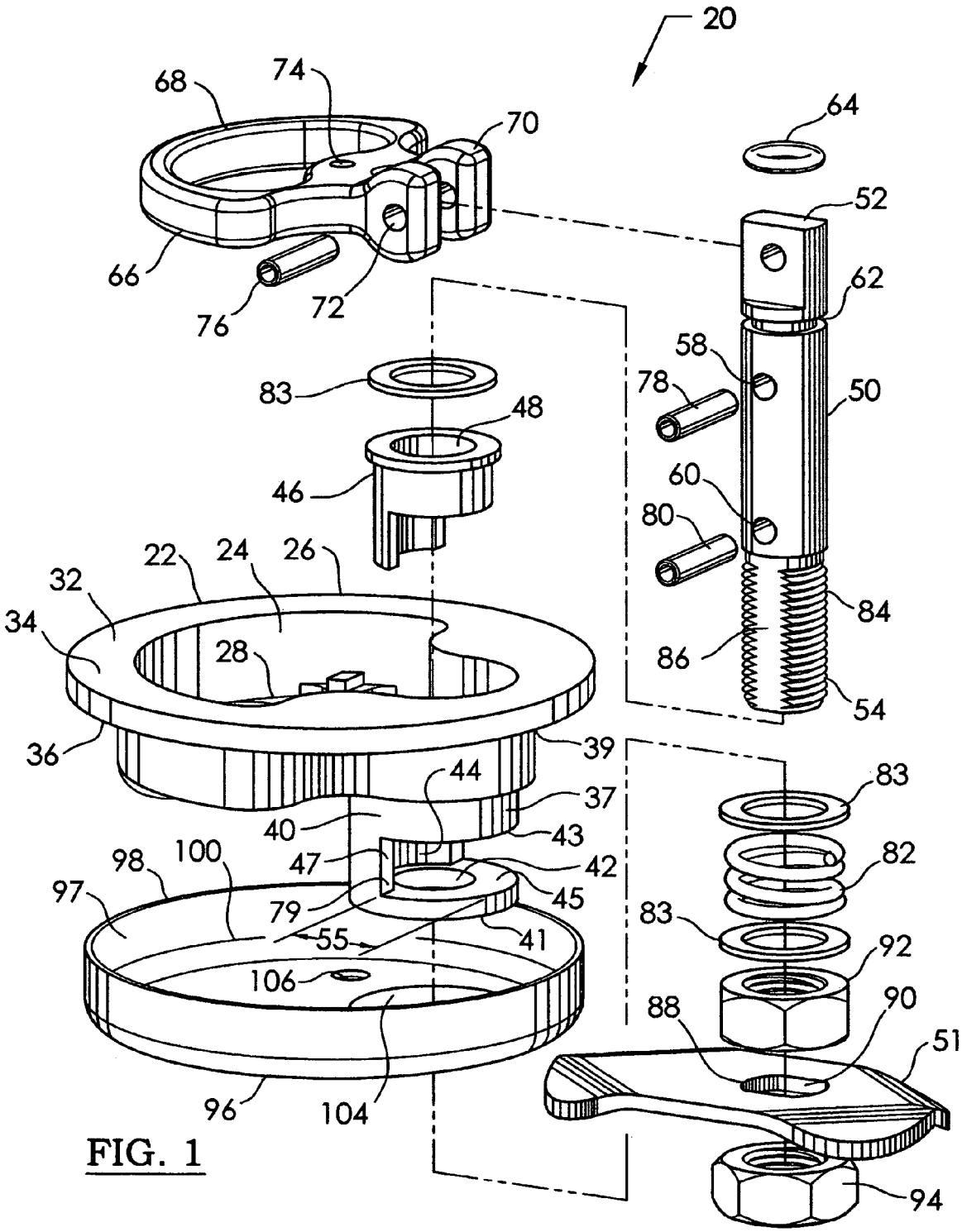
FIG. 1 is an exploded perspective view of a D-handle latch constructed in accordance with the invention.
Figure 2:
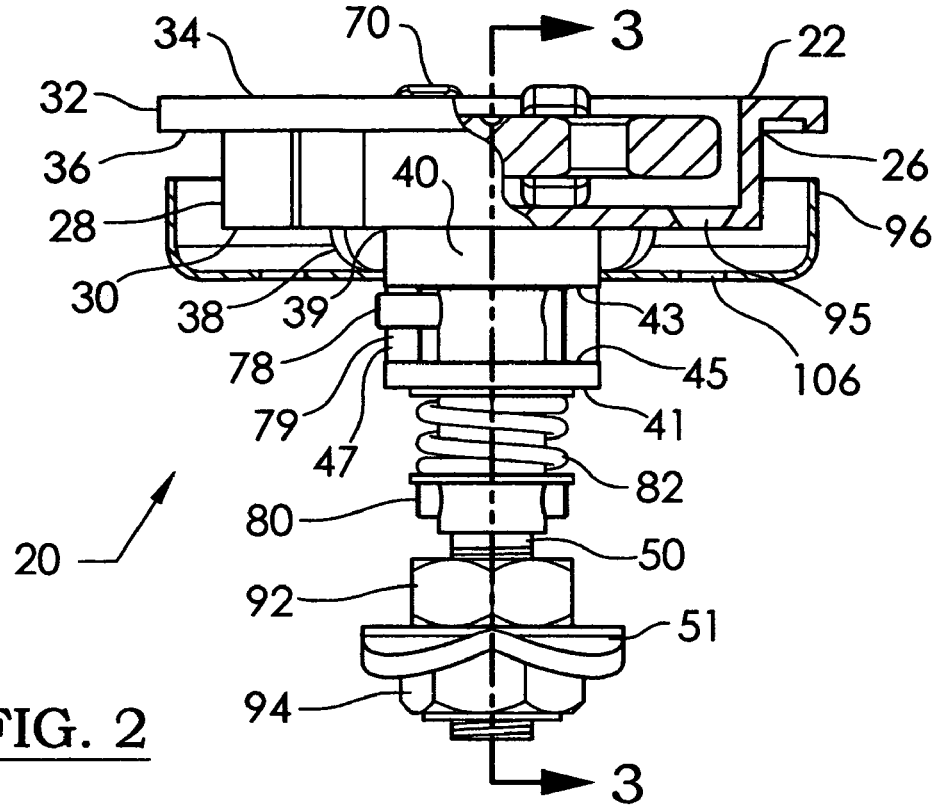
FIG. 2 is a front elevational view of the D-handle latch of FIG. 1, including a partial section taken along lines 2-2 of FIG. 3.
Figure 3:
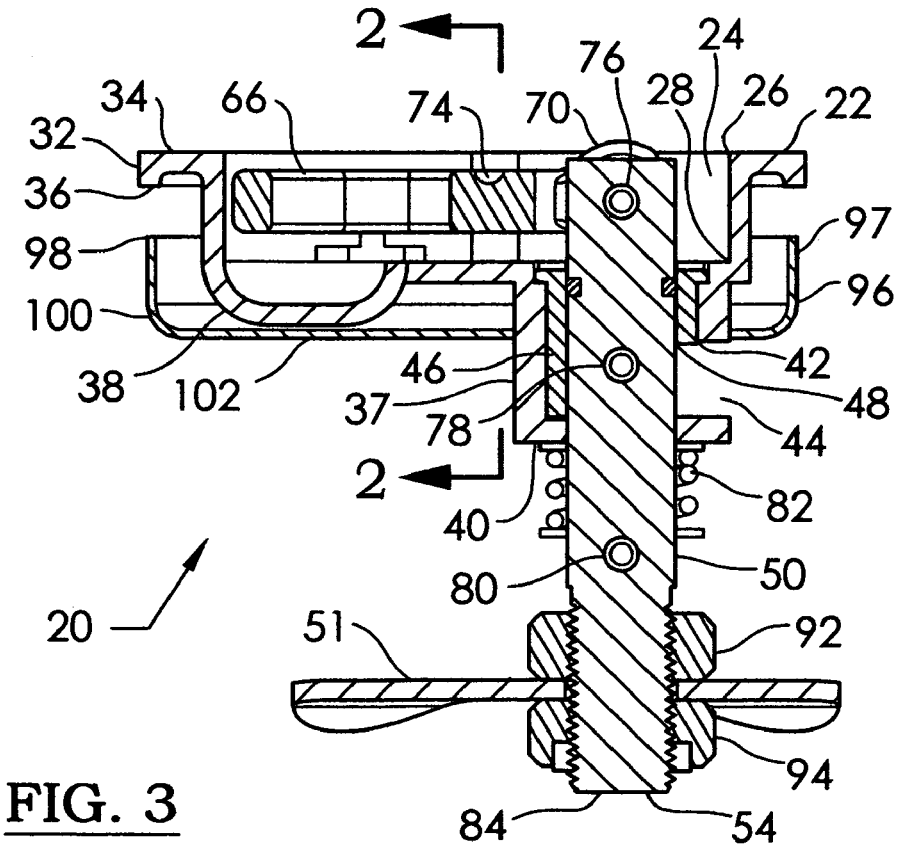
FIG. 3 is a left side sectional elevational view of the D-handle latch of FIG. 1, taken along lines 3-3 of FIG. 2.

Referring now to the drawing, and especially to FIGS. 1 through 7 thereof, a latch is shown at 20, and is for use in connection with a boat hatch (not shown) having a compression seal and a hatch jamb (not shown). The latch 20 comprises a housing 22 having a well 24 extending between opposite upper 26 and lower 28 ends. The well 24 has a floor 30 enclosing the lower end 28. The housing 22 has a flange 32 extending outward from the well upper end 26, and all around the housing periphery. The flange 32 has a top surface 34 and a bottom surface 36, with the bottom surface 36 being adapted for mounting against the boat hatch. The housing 22 has a pocket 38 extending downward from the floor 30. The housing 22 has a boss 40 extending downward from a proximal end 39 at the floor 30 to a distal end 41. The boss 40 has an outer periphery 37, and a vertical central axis. The boss 40 has a vertical bore 42 aligned with the central axis and extending through the boss 40. A bushing 46 is received in the boss vertical bore 42. The bushing 46 has a bushing bore 48 extending vertically through it.

A pull shaft 50 extends between opposite upper 52 and lower 54 ends, and has a longitudinal axis. The pull shaft 50 has a first hole 56 transversely through it adjacent the pull shaft upper end 52. The pull shaft 50 has a second hole 58 transversely through it below the first hole 56, the second hole 58 being juxtaposed with the slot 44. The pull shaft 50 has a third hole 60 transversely through it below the second hole 58. In general terms, the pull shaft 50 is mounted in the vertical bore 42 for rotational and sliding movement. More specifically, the pull shaft 50 is mounted in the bushing bore 48 for rotational movement and sliding movement along the vertical central axis between an upper position 49 and a lower position 53.

The pull shaft 50 has an annular O-ring groove 62 disposed between the first 56 and second 58 holes. An O-ring 64 is received in the O-ring groove 62 for slidingly sealing the pull shaft 50 against the bushing bore 48, so as to prevent water intrusion through the latch 20.

A latch bar 51 is mounted on the pull shaft lower end 54 and projects transversely outward. The latch bar 51 is adapted for engaging the hatch jamb.

Figure 6:
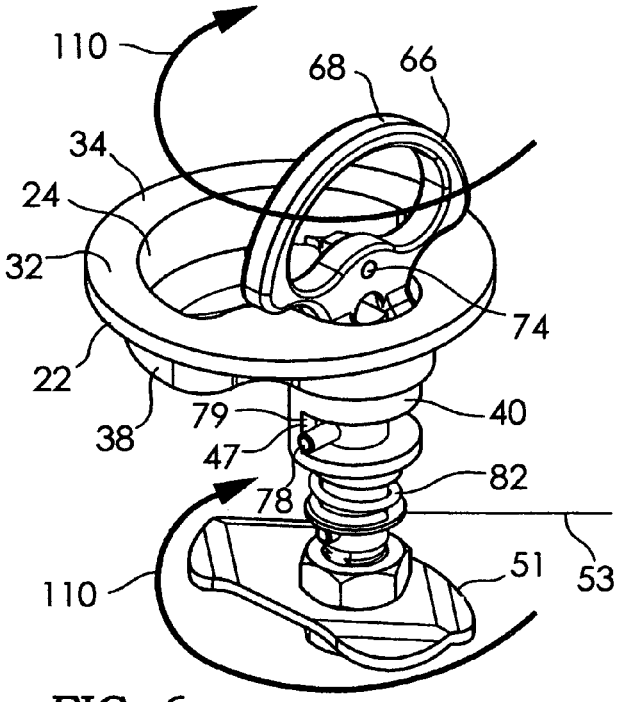
FIG. 6 is a perspective of the D-handle latch of FIG. 1, showing the latch rotated into the open, or unlatched position.
Figure 7:
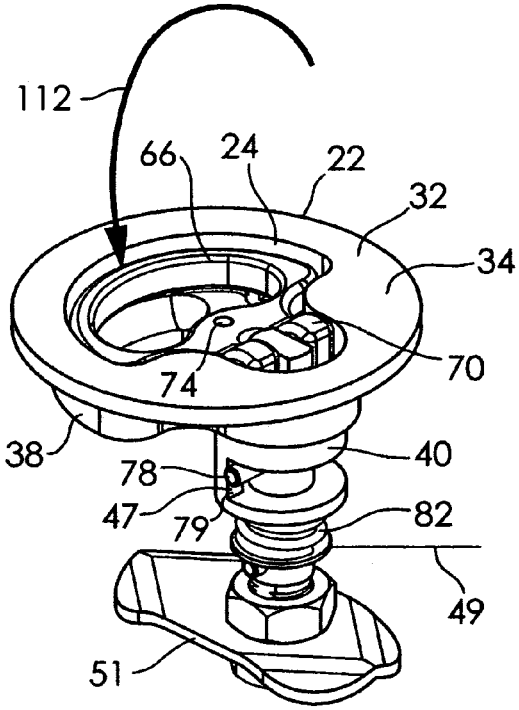
FIG. 7 is a perspective view of the D-handle latch of FIG. 1, showing the latch in the unlatched position, and the handle pivoted downward.
Figure 8:
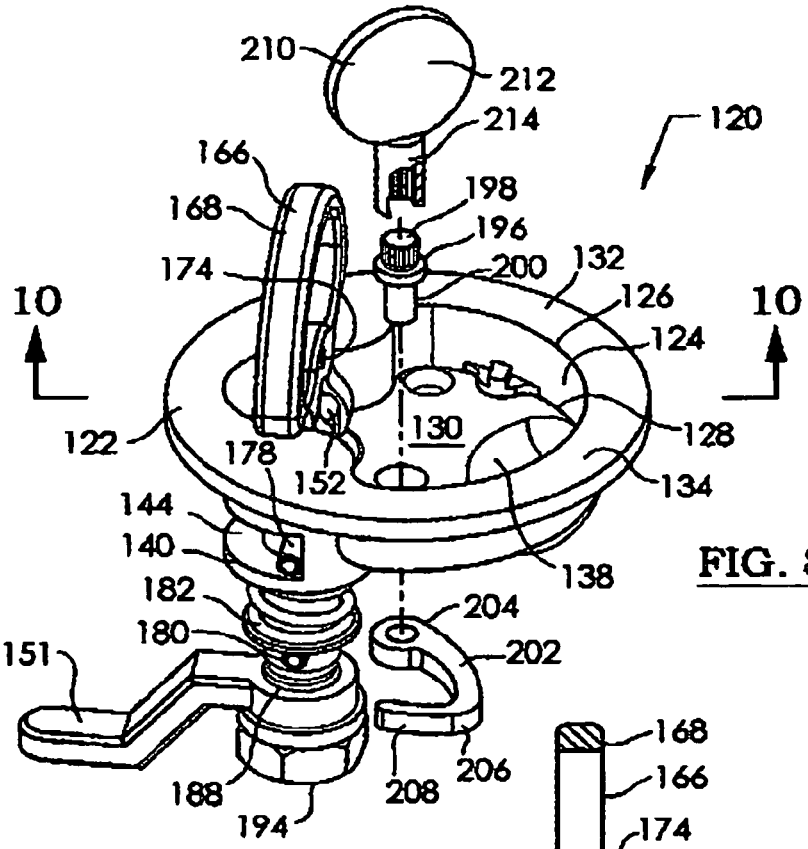
FIG. 8 is a perspective view of another D-handle latch constructed in accordance with the invention.
Figure 9:
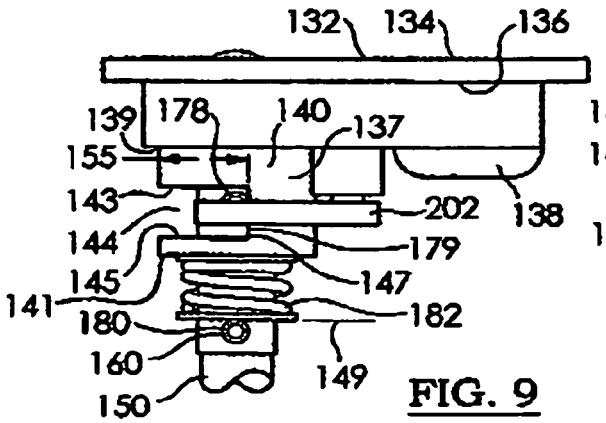
FIG. 9 is a right side elevational view of the D-handle latch of FIG. 8.
Figure 10:
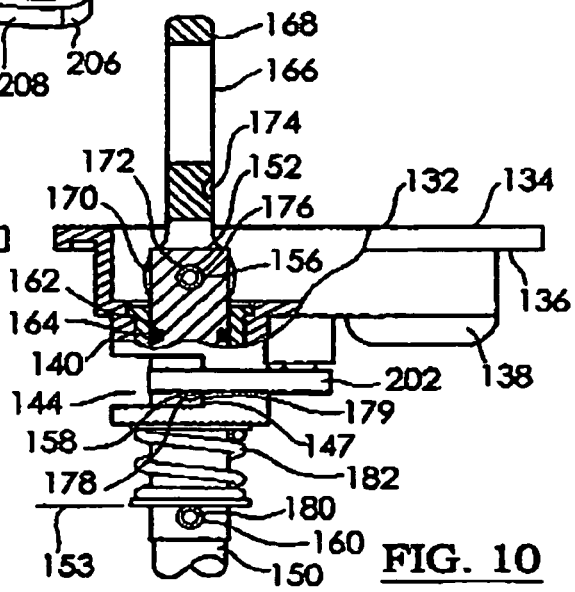
FIG. 10 is another right side elevational view of the D-handle latch of FIG. 8, including a partial section taken along lines 10-10 of FIG. 8.

A handle 66 is provided, which has a grasping portion 68 and two ears 70 extending outward from the grasping portion 68. The handle 66 shown in the drawing is a D-shaped handle. It is to be understood that the handle 66 can take any shape, such as a T-shaped handle. The purpose of the pocket 38 is to facilitate inserting a finger under the grasping portion 68 to lift the handle 66. The ears 70 have collinear pivot holes 72 transversely through them. The handle 66 is pivotally mounted on the pull shaft 50 with the ears 70 straddling the pull shaft upper end 52 and the pivot holes 72 aligned with the pull shaft first hole 56. This allows pivotal movement from a handle position projecting upward to a handle position lying within the well, as shown in FIGS. 6 and 7. The ears 70 each have a cam lobe shape, so as to cause the pull shaft 50 to slide axially in the vertical bore 42 and the bushing bore 48 to the lower position 53 as the handle is raised, and to the upper position 49 as the handle is lowered. The handle 66 has a dimple 74 with a brightly colored pigment therein. The dimple 74 is visible when the handle 66 is lying within the well 24 and the latch 20 is in the unlatched position. This will clearly indicate, by visual inspection, that the latch in the unlatched position.

A first pin 76 is received in the pivot holes 72 and the pull shaft first hole 56. The first pin 76 will pivotally mount the handle 66 to the pull shaft upper end 52.

A second pin 78 is received in the pull shaft second hole 58. The second pin 78 projects outward on only one side of the pull shaft 50.

The boss 40 has a slot 44 extending transversely through the boss 40 and through the vertical bore 42. The slot 44 extends vertically along the central axis from an upper terminal surface 43 to a lower terminal surface 45. The lower terminal surface 45 is above the boss distal end 41. The upper 43 and lower 45 terminal surfaces are generally planar and generally perpendicular to the central axis. The upper terminal surface 43 faces downward, and the lower terminal surface 45 faces upward. The slot 44 is juxtaposed with the second hole 58. The distance between the upper terminal surface 43 and the lower terminal surface 45 is sufficient to allow the second pin 78 to travel within the slot 44 between the upper position 49 and the lower position 53. The slot 44 has a slot wall 47 extending generally vertically between the upper terminal surface 43 and the lower terminal surface 45. The slot 44 has a transverse depth 55 extending from the boss periphery 37 inward past the central axis to the slot wall 47. The transverse depth 55 is sufficient to allow the second pin 78 to rotate one half turn before striking the slot wall 47 in either direction, thereby defining a rotation stop 79. The second pin 78 will contact the slot wall 47 at the predetermined rotational position and at a second rotational position approximately one-half turn from the predetermined rotational position. This contact will stop the latch bar 51 in the latched and unlatched positions, respectively.

A third pin 80 is received in the pull shaft third hole 60, and projects outward on both sides of the pull shaft 50.

A spring 82 is mounted for downward bearing against the pull shaft 50 and upward bearing against the housing 22. Specifically, the coil spring 82 is mounted generally concentrically on the pull shaft 50. The spring 82 bears upward on the boss distal end 41 and downward on the third pin 80. This is to bias the pull shaft 50 downward with respect to the housing 22. The spring 82 is disposed below the rotation stop 79. This placement is necessary to allow inspection, lubrication, and replacement of the spring 82 without removing the pull shaft 50 from the housing 22. Optionally, three thrust washers 83 can be installed to distribute stresses and reduce wear. One thrust washer 83 is above the bushing 46, one above the spring 82, and one below the spring 82.

Attaching means is provided for attaching the latch bar 51 on the pull shaft lower end 54. The attaching means comprises threads 84 on the pull shaft lower end 54. One embodiment of the attaching means includes at least one flat 86 on the pull shaft lower end 54 and generally parallel to the pull shaft longitudinal axis. Preferably, two flats 86 are provided, one on each side of the pull shaft 50. The latch bar 51 has a mounting hole 88 through it with at least one, and preferably two flats 90. The latch bar 51 is mounted on the pull shaft lower end 54. The latch bar flats 90 engage the pull shaft flats 86, so as to prevent the latch bar 51 from rotating on the pull shaft 50. A first nut 92 is threaded onto the pull shaft lower end 54 above the latch bar 51. A second nut 94 is threaded onto the pull shaft lower end 54 below the latch bar 51. The second nut 94 is preferably a nylon insert locking type.

The boat hatch will have a receiving hole (not shown) through it, into which the housing well 24 will be inserted. The bottom surface 36 of the flange 32 is mounted flush against the boat hatch. Fastening means is provided for fastening the latch 20 to the boat hatch. The latch housing 22 has two mounting holes 95 through the floor 30. A shell 96 has an annular wall 97 extending between opposite upper 98 and lower 100 ends. The shell 96 is open at the wall upper end 98. The shell 96 has a plate 102 extending outward to the wall lower end 100. The plate 102 has a first hole 104 through it at least large enough to pass the pull shaft 50, and preferably large enough to pass the boss 40. The plate 102 has second and third 106 holes smaller than the first hole 104. Two threaded fasteners (not shown) are provided. Upon assembly, the latch housing 22 will be received in the hatch receiving hole from above. The shell 96 will be juxtaposed with the latch housing 22 beneath the hatch. The pull shaft 50 and the boss 40 will pass through the plate first hole 104. The two threaded fasteners will extend between the latch housing mounting holes 95 and the shell second and third holes 106. The two threaded fasteners will draw the shell 96 and the latch housing 22 together, clamping them to the hatch.

Figure 4:
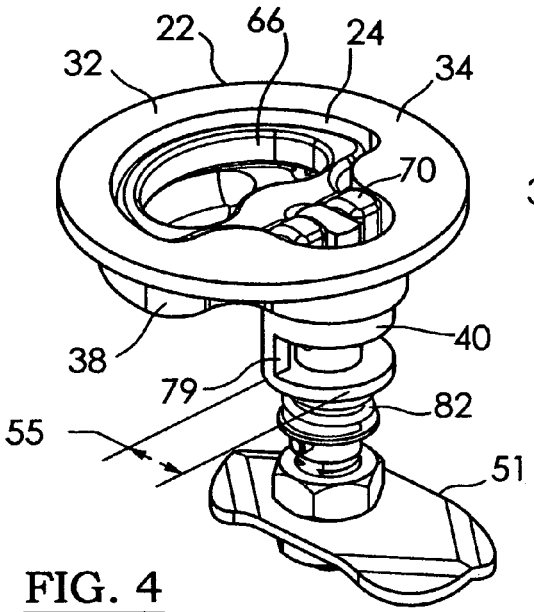
FIG. 4 is a perspective view of the D-handle latch of FIG. 1, showing the latch in the closed, or latched position.
Figure 5:
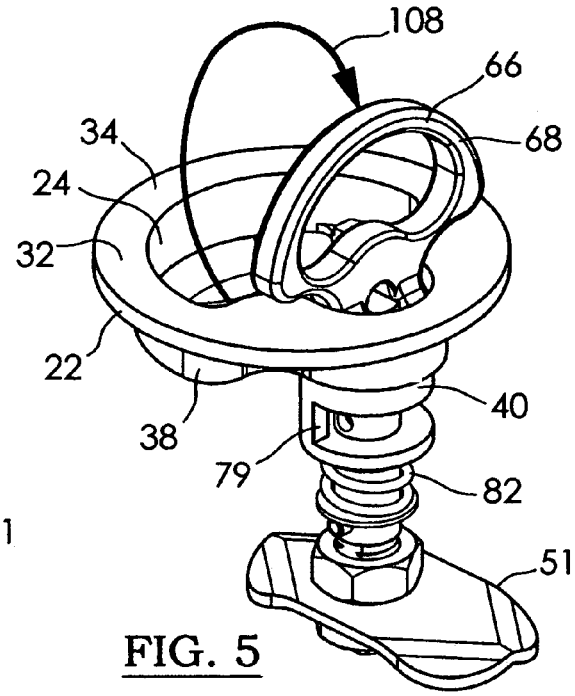
FIG. 5 is a perspective view of the D-handle latch of FIG. 1, showing the latch in the latched position, and the handle pivoted upward.

To operate the latch, start with the latch bar 51 in the latched position, as shown in FIG. 4. The handle 66 will lie flush with the housing 22 inside the well 24. The handle 66 will then be pivoted into an upright position, arrow 108, and the cam lobe ears 70 and spring 82 will cause the pull shaft 50 to slide axially downward to the lower position, as in FIG. 5. The handle 66 will then be rotated one-half turn, arrow 110, so that the latch bar 51 disengages from the hatch jamb, as depicted in FIG. 6. Notice that the second pin 78 is now in contact with the slot wall 47, to stop the rotation. The handle 66 will then be pivoted downward, arrow 112, so that the handle 66 will lie flush with the housing 22 inside the well 24, as in FIG. 7. In this position, the dimple 74 indicates that the latch is in the unlatched position. Reversing the procedure, the latch bar 51 is in the unlatched position, as shown in FIG. 7. The handle 66 lies flush with the housing 22 inside the well 24. The handle 66 will then be pivoted into an upright position, and the cam lobe ears 70 and spring 82 will cause the pull shaft 50 to slide axially downward to the lower position, as in FIG. 6. The handle will then be rotated one-half turn so that the latch bar 51 engages the hatch jamb in a latched position, as in FIG. 5. The handle 66 will then be pivoted downward so that the handle 66 will lie flush with the housing 22 inside the well 24, as illustrated in FIG. 4. As the handle 66 moves downward, the cam lobe ears 70 will cause the pull shaft 50 to slide axially upward to the upper position and thereby raise the latch bar 51 so as to increase the compression between the hatch and the seal for watertight closure.

Turning now to FIGS. 8 through 12, another embodiment of the latch is shown at 120. Latch 120 is similar to latch 20 described above, in that it is for use in connection with a boat hatch (not shown) having a compression seal and a hatch jamb (not shown). The latch 120 comprises a housing 122 having a well 124 extending between opposite upper 126 and lower 128 ends. The well 124 has a floor 130 enclosing the lower end 128. The housing 122 has a flange 132 extending outward from the well upper end 126, and all around the housing periphery. The flange 132 has a top surface 134 and a bottom surface 136, with the bottom surface 136 being adapted for mounting against the boat hatch. The housing 122 has a pocket 138 extending downward from the floor 130. The housing 122 has a boss 140 extending downward from a proximal end 139 at the floor 130 to a distal end 141. The boss 140 has an outer periphery 137, and a vertical central axis. The boss 140 has a vertical bore 142 aligned with the central axis and extending through the boss 140. A bushing 146 is received in the boss vertical bore 142. The bushing 146 has a bushing bore 148 extending vertically through it.

A pull shaft 150 extends between opposite upper 152 and lower 154 ends, and has a longitudinal axis. The pull shaft 150 has a first hole 156 transversely through it adjacent the pull shaft upper end 152. The pull shaft 150 has a second hole 158 transversely through it below the first hole 156, the second hole 158 being juxtaposed with the slot 144. The pull shaft 150 has a third hole 160 transversely through it below the second hole 158. The pull shaft 150 is mounted in the bushing bore 148 for rotational movement and sliding movement along the vertical central axis between an upper position 149 and a lower position 153. The pull shaft 150 has an annular O-ring groove 162 disposed between the first 156 and second 158 holes. An O-ring 164 is received in the O-ring groove 162 for slidingly sealing the pull shaft 150 against the bushing bore 148.

A latch bar 151 projects transversely outward from the pull shaft lower end 154 and is adapted for engaging the hatch jamb. Threads 184 are provided on the pull shaft lower end 154. A threaded mounting hole 188 extends through the latch bar 151. The latch bar 151 is threaded onto the pull shaft lower end 154. A nut 194 is tightened against the latch bar 151. Although this latch bar 151 differs from latch bar 51 described above, it is to be understood that either latch bar 151 or 51 can be used with either latch embodiment 20 or 120.

A handle 166 is provided, which has a grasping portion 168 and two ears 170 extending outward from the grasping portion 168. The ears 170 have collinear pivot holes 172 transversely through them. The handle 166 is pivotally mounted on the pull shaft 150 with the ears 170 straddling the pull shaft upper end 152 and the pivot holes 172 aligned with the pull shaft first hole 156. The ears 170 each have a cam lobe shape, so as to cause the pull shaft 150 to slide axially in the vertical bore 142 and the bushing bore 148 to the lower position 153 as the handle is raised, and to the upper position 149 as the handle is lowered. The handle 166 has a dimple 174 with a brightly colored pigment therein to indicate that the latch is in the unlatched position. The dimple 174 is visible when the handle 166 is lying within the well 124 and the latch 120 is in the unlatched position.

A first pin 176 is received in the pivot holes 172 and the pull shaft first hole 156.

A second pin 178 is received in the pull shaft second hole 158. The second pin 178 projects outward on only one side of the pull shaft 150.

The boss 140 has a slot 144 extending transversely through the boss 140 and through the vertical bore 142. The slot 144 extends vertically along the central axis from an upper terminal surface 143 to a lower terminal surface 145. The lower terminal surface 145 is above the boss distal end 141. The upper 143 and lower 145 terminal surfaces are generally planar and generally perpendicular to the central axis. The upper terminal surface 143 faces downward, and the lower terminal surface 145 faces upward. The slot 144 is juxtaposed with the second hole 158. The distance between the upper terminal surface 143 and the lower terminal surface 145 is sufficient to allow the second pin 178 to travel within the slot 144 between the upper position 149 and the lower position 153. The slot 144 has a slot wall 147 extending generally vertically between the upper terminal surface 143 and the lower terminal surface 145. The slot 144 has a transverse depth 155 extending from the boss periphery 137 inward past the central axis to the slot wall 147. The transverse depth 155 is sufficient to allow the second pin 178 to rotate one half turn before striking the slot wall 147 in either direction, thereby defining a rotation stop 179. The second pin 178 will contact the slot wall 147 at the predetermined rotational position and at a second rotational position approximately one-half turn from the predetermined rotational position. This contact will stop the latch bar 151 in the latched and unlatched positions, respectively.

A third pin 180 is received in the pull shaft third hole 160, and projects outward on both sides of the pull shaft 150.

A coil spring 182 is mounted generally concentrically on the pull shaft 150. The spring 182 bears upward on the boss distal end 141 and downward on the third pin 180. This is to bias the pull shaft 150 downward with respect to the housing 122. The spring 182 is disposed below the rotation stop 179. This placement is necessary to allow inspection, lubrication, and replacement of the spring 182 without removing the pull shaft 150 from the housing 122.

The boat hatch will have a receiving hole (not shown) through it, into which the housing well 124 will be inserted. The bottom surface 136 of the flange 132 is mounted flush against the boat hatch. Fastening means is provided for fastening the latch 120 to the boat hatch. The fastening means is not shown, but is the same as that for latch 20.

Latch 120 differs from latch 20 described above, in that latch 120 includes a lock for security. A lock shaft 196 extends between opposite upper 198 and lower 200 ends. The lock shaft 196 is mounted for rotation in the housing floor 130 with the lower end 200 projecting below the housing floor 130. A hook 202 extends between opposite proximal 204 and distal 206 ends. The hook proximal end 204 is attached to the lock shaft lower end 200. The hook distal end 206 has a finger 208 projecting transversely outward therefrom. The finger 208 is adapted for engagement with the second pin 178. The finger 208 is of a predetermined thickness sufficient to maintain engagement with the second pin 178 as the pull shaft 150 slides between the upper position and the lower position, as shown, in FIGS. 9 and 10.

A key 210 has a handle 212 for grasping, and a stem 214 extending from the handle 212. The stem 214 is configured to releasably engage the lock shaft upper end 198 so as to transmit rotational motion from the key 210 to the lock shaft 196. Typically, the lock shaft upper end 198 will have a male spline, and the key 210 a matching female spline. However, it is to be understood that any shape that transmits rotation from the key 210 to the lock shaft 196 will be suitable.

Thus, starting with the latch bar 151 and pull shaft 150 in the latched position, upon turning the key 210 in a first direction, the lock shaft 196 and hook 202 will rotate in the first direction, arrow 216 in FIG. 12. The finger 208 will move into juxtaposition with the second pin 178, enclosing the second pin 178 between the finger 208 and the boss slot 144. This prevents rotation of the pull shaft 150 and unlatching of the latch bar 151. Upon turning the key 210 in a second direction opposite to the first direction, the lock shaft 196 and hook 202 will rotate in the second direction, arrow 218 in FIG. 11. The finger 208 will move away from the second pin 178, thereby allowing rotation of the pull shaft 150 and unlatching of the latch bar 151.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

PARTLIST

PART

NO. DESCRIPTION

20 latch
22 housing
24 well
26 well upper end
28 well lower end
30 floor
32 flange
34 flange top surface
36 flange bottom surface
37 boss outer periphery
38 pocket
39 boss proximal end
40 boss
41 boss distal end
42 boss vertical bore
43 slot upper terminal surface
44 slot
45 slot lower terminal surface
46 bushing
47 slot wall
48 bushing bore
49 pull shaft upper position
50 pull shaft
51 latch bar
52 pull shaft upper end
53 pull shaft lower position
54 pull shaft lower end
55 slot transverse depth
56 first hole
58 second hole
60 third hole
62 O-ring groove
64 O-ring
66 handle
68 grasping portion
70 ears
72 pivot holes
74 dimple
76 first pin
78 second pin
79 rotation stop
80 third pin
82 coil spring
83 thrust washer
84 threads
86 pull shaft flats
88 latch bar mounting hole
90 latch bar flats
92 first nut
94 second nut
95 housing mounting holes
96 shell
97 shell annular wall
98 shell wall upper end
100 shell wall lower end
102 shell plate
104 shell first hole
106 shell second & third holes
108 upward arrow
110 rotate arrow
112 downward arrow
120 latch
122 housing
124 well
126 well upper end
128 well lower end
130 floor
132 flange
134 flange top surface
136 flange bottom surface
138 pocket
140 boss
142 boss vertical bore
144 slot
146 bushing
148 bushing bore
150 pull shaft
151 latch bar
152 pull shaft upper end
154 pull shaft lower end
156 first hole
158 second hole
160 third hole
162 O-ring groove
164 O-ring
166 handle
168 grasping portion
170 ears
172 pivot holes
174 dimple
176 first pin
178 second pin
179 rotation stop
180 third pin
182 coil spring
184 threads
188 latch bar mounting hole
194 nut
196 lock shaft
198 lock shaft upper end
200 lock shaft lower end
202 hook
204 hook proximal end
206 hook distal end
208 hook finger
210 key

212 key handle
214 key stem
216 close lock arrow
218 open lock arrow—

The embodiments of the invention in which an exclusive property or privilege is claimed are defined as follows:

1. A latch for use in connection with a boat hatch having a compression seal and a hatch jamb, the latch comprising:

a housing, the housing having a well extending between opposite upper and lower ends, the well having a floor enclosing the lower end, the housing having a flange extending outward from the well upper end, the flange having a top surface and a bottom surface, the flange bottom surface being adapted for mounting against the boat hatch, the housing having a boss extending downward from a proximal end at the floor to a distal end, the boss having an outer periphery, the boss having a vertical central axis, the boss having a vertical bore aligned with the central axis and extending through the boss, the boss having a slot extending transversely through the boss and through the vertical bore;

a pull shaft, the pull shaft extending between opposite upper and lower ends, the pull shaft having a longitudinal axis, the pull shaft having a first hole transversely therethrough adjacent the pull shaft upper end, the pull shaft having a second hole transversely therethrough below the first hole, the pull shaft being mounted in the vertical bore for rotational movement and sliding movement along the vertical central axis between an upper position and a lower position;

stopping means for stopping the rotational movement of the pull shaft at a predetermined rotational position;

a spring, the spring being mounted for downward bearing against the pull shaft and upward bearing against the housing, so as to bias the pull shaft downward with respect to the housing, the spring being disposed below the stopping means, so as to allow inspection, lubrication, and replacement of the spring without removing the pull shaft from the housing;

a handle, the handle having a grasping portion, the handle having two ears extending outward from the grasping portion, the ears having collinear pivot holes transversely therethrough, the handle being pivotally mounted on the pull shaft with the ears straddling the pull shaft upper end and the pivot holes aligned with the pull shaft first hole for pivotal movement from a handle position projecting upward to a handle position lying within the well, the ears each having a cam lobe shape, so as to cause the pull shaft to slide axially in the vertical bore to the lower position as the handle is raised and to the upper position as the handle is lowered;

a first pin received in the pivot holes and the pull shaft first hole, so as to pivotally mount the handle to the pull shaft upper end;

a second pin received in the pull shaft second hole, the second pin projecting outward on only one side of the pull shaft; and a latch bar, the latch bar being mounted on the pull shaft lower end, the latch bar being adapted for engaging the hatch jamb;

attaching means for attaching the latch bar on the pull shaft lower end;

fastening means for fastening the latch to the boat hatch;

a lock shaft extending between opposite upper and lower ends, the lock shaft being mounted for rotation in the housing floor with the lower end projecting below the housing floor;

a hook extending between opposite proximal and distal ends, the hook proximal end being attached to the lock shaft lower end, the hook distal end having a finger projecting transversely outward therefrom, the finger being adapted for engagement with the second pin, the finger being of a predetermined thickness sufficient to maintain engagement with the second pin as the pull shaft slides between the upper position and the lower position; and a key having a handle for grasping, the key having a stem extending from the handle, the stem being configured to releasably engage the lock shaft upper end so as to transmit rotational motion from the key to the lock shaft;

so that with the latch bar in an unlatched position, the handle will lie flush with the housing inside the well, and the handle will then be pivoted into an upright position, the cam lobe shaped ears and spring will cause the pull shaft to slide axially downward to the lower position, the handle will then be rotated one-half turn so that the latch bar engages the hatch jamb in a latched position, the handle will be pivoted downward so that the handle will lie flush with the housing inside the well, the cam lobes will cause the pull shaft to slide axially upward to the upper position and thereby raise the latch bar so as to increase the compression between the hatch and the seal for watertight closure; and so that, with the latch bar and pull shaft in the latched position, upon turning the key in a first direction, the lock shaft and hook will rotate in the first direction, the finger will move into juxtaposition with the second pin, enclosing the second pin between the finger and the boss slot, thereby preventing rotation of the pull shaft and unlatching of the latch bar, and upon turning the key in a second direction opposite to the first direction, the lock shaft and hook will rotate in the second direction, the finger will move away from the second pin, thereby allowing rotation of the pull shaft and unlatching of the latch bar.

2. The latch of claim 1, wherein the stopping means further comprises:

a slot extending transversely through the boss and through the vertical bore, the slot extending vertically along the central axis from an upper terminal surface to a lower terminal surface, the lower terminal surface being above the boss distal end, the upper and lower terminal surfaces being generally planar and generally perpendicular to the central axis, the upper terminal surface facing downward, the lower terminal surface facing upward, the slot being juxtaposed with the second hole, the distance between the upper terminal surface and the lower terminal surface being sufficient to allow the second pin to travel within the slot between the upper position and the lower position, the slot having a slot wall extending generally vertically between the upper terminal surface and the lower terminal surface, the slot having a transverse depth extending from the boss periphery inward past the central axis to the slot wall, the transverse depth being sufficient to allow the second pin to rotate one half turn before striking the slot wall in either direction, thereby defining a rotation stop; so that the second pin will contact the slot wall at the predetermined rotational position and at a second rotational position approximately one-half turn from the predetermined rotational position, thereby stopping the latch bar in the latched and unlatched positions, respectively.

3. The latch of claim 1, wherein the attaching means further comprises:

the pull shaft lower end being threaded;

the latch bar having a threaded mounting hole therethrough, the latch bar being mounted on the pull shaft lower end; and a nut threaded onto the pull shaft lower end below the latch bar.

4. The latch of claim 1, further comprising a bushing received in the boss vertical bore, the bushing having a bushing bore, the pull shaft being slidingly received in the bushing bore, for reducing sliding friction of the pull shaft within the housing.

5. The latch of claim 1, further comprising:

the pull shaft having a third hole transversely therethrough below the second hole;

a third pin received in the pull shaft third hole, the third pin projecting outward on both sides of the pull shaft; and the spring being a coil spring mounted generally concentrically on the pull shaft, the spring bearing upward on the boss distal end and downward on the third pin.

6. The latch of claim 1, further comprising:

the pull shaft having an annular O-ring groove disposed between the first and second holes; and an O-ring received in the O-ring groove for slidingly sealing the pull shaft, so as to prevent water intrusion through the latch.

7. The latch of claim 1, wherein the handle further comprises a dimple, the dimple having a brightly colored pigment therein, the dimple being visible when the handle is lying within the well and the latch is in the unlatched position, so as to clearly indicate, by visual inspection, that the latch in the unlatched position.

8. A latch for use in connection with a boat hatch having a compression seal and a hatch jamb, the latch comprising:

a housing, the housing having a well extending between opposite upper and lower ends, the well having a floor enclosing the lower end, the housing having a flange extending outward from the well upper end, the flange having a top surface and a bottom surface, the flange bottom surface being adapted for mounting against the boat hatch, the housing having a pocket extending downward from the floor, the housing having a boss extending downward from a proximal end at the floor to a distal end, the boss having an outer periphery, the boss having a vertical central axis, the boss having a vertical bore aligned with the central axis and extending through the boss;

a pull shaft, the pull shaft extending between opposite upper and lower ends, the pull shaft having a longitudinal axis, the pull shaft having a first hole transversely therethrough adjacent the pull shaft upper end, the pull shaft having a second hole transversely therethrough below the first hole, the pull shaft having a third hole transversely therethrough below the second hole, the pull shaft being mounted in the vertical bore for rotational movement and sliding movement along the vertical central axis between an upper position and a lower position;

a handle, the handle having a grasping portion, the handle having two ears extending outward from the grasping portion, the ears having collinear pivot holes transversely therethrough, the handle being pivotally mounted on the pull shaft with the ears straddling the pull shaft upper end and the pivot holes aligned with the pull shaft first hole for pivotal movement from a handle position projecting upward to a handle position lying within the well, the ears each having a cam lobe shape, so as to cause the pull shaft to slide axially in the vertical bore to the lower position as the handle is raised and to the upper position as the handle is lowered, the handle having a dimple, the dimple having a brightly colored pigment therein, the dimple being visible when the handle is lying within the well and the latch is in the unlatched position, so as to clearly indicate, by visual inspection, that the latch in the unlatched position;

a first pin received in the pivot holes and the pull shaft first hole, so as to pivotally mount the handle to the pull shaft upper end;

a second pin received in the pull shaft second hole, the second pin projecting outward on only one side of the pull shaft;

the boss having a slot extending transversely through the boss and through the vertical bore, the slot extending vertically along the central axis from an upper terminal surface to a lower terminal surface, the lower terminal surface being above the boss distal end, the upper and lower terminal surfaces being generally planar and generally perpendicular to the central axis, the upper terminal surface facing downward, the lower terminal surface facing upward, the slot being juxtaposed with the second hole, the distance between the upper terminal surface and the lower terminal surface being sufficient to allow the second pin to travel within the slot between the upper position and the lower position, the slot having a slot wall extending generally vertically between the upper terminal surface and the lower terminal surface, the slot having a transverse depth extending from the boss periphery inward past the central axis to the slot wall, the transverse depth being sufficient to allow the second pin to rotate one half turn before striking the slot wall in either direction, thereby defining a rotation stop;

a latch bar, the latch bar being mounted on the pull shaft lower end and projecting transversely outward, the latch bar being adapted for engaging the hatch jamb; so that the second pin will contact the slot wall at the predetermined rotational position and at a second rotational position approximately one-half turn from the predetermined rotational position, thereby stopping the latch bar in the latched and unlatched positions, respectively;

a third pin received in the pull shaft third hole, the third pin projecting outward on both sides of the pull shaft;

a spring, the spring being a coil spring mounted generally concentrically on the pull shaft, the spring bearing upward on the boss distal end and downward on the third pin, so as to bias the pull shaft downward with respect to the housing, the spring being disposed below the rotation stop, so as to allow inspection, lubrication, and replacement of the spring without removing the pull shaft from the housing;

attaching means for attaching the latch bar on the pull shaft lower end; and fastening means for fastening the latch to the boat hatch;

so that with the latch bar in an unlatched position, the handle will lie flush with the housing inside the well, and the handle will then be pivoted into an upright position, the cam lobe shaped ears and spring will cause the pull shaft to slide axially downward to the lower position, the handle will then be rotated one-half turn so that the latch bar engages the hatch jamb in a latched position, the handle will be pivoted downward so that the handle will lie flush with the housing inside the well, the cam lobes will cause the pull shaft to slide axially upward to the upper position and thereby raise the shaft and latch bar so as to increase the compression between the hatch and the seal for watertight closure.

9. The latch of claim 8, wherein the attaching means further comprises:

the pull shaft lower end being threaded;

the latch bar having a threaded mounting hole therethrough, the latch bar being mounted on the pull shaft lower end; and a nut threaded onto the pull shaft lower end below the latch bar.

10. The latch of claim 8, wherein the hatch includes a receiving hole therethrough adapted to receive the latch housing, and the fastening means further comprises:

the latch housing having two mounting holes through the floor;

a shell, the shell having an annular wall extending between opposite upper and lower ends, the shell being open at the wall upper end, the shell having a plate extending outward to the wall lower end, the plate having a first hole therethrough at least large enough to pass the pull shaft, the plate having second and third holes therethrough smaller than the first hole; and two threaded fasteners;

so that upon assembly, the latch housing will be received in the hatch receiving hole from above, the shell will be juxtaposed with the latch housing beneath the hatch, the pull shaft will pass through the plate first hole, and the two threaded fasteners will extend between the latch housing mounting holes and the shell second and third holes.

11. The latch of claim 8, further comprising a bushing received in the boss vertical bore, the bushing having a bushing bore, the pull shaft being slidingly received in the bushing bore, for reducing sliding friction of the pull shaft within the housing.

12. The latch of claim 8, further comprising:

the pull shaft having an annular O-ring groove disposed between the first and second holes; and an O-ring received in the O-ring groove for slidingly sealing the pull shaft, so as to prevent water intrusion through the latch.

13. The latch of claim 8, further comprising:

a lock shaft extending between opposite upper and lower ends, the lock shaft being mounted for rotation in the housing floor with the lower end projecting below the housing floor;

a hook extending between opposite proximal and distal ends, the hook proximal end being attached to the lock shaft lower end, the hook distal end having a finger projecting transversely outward therefrom, the finger being adapted for engagement with the second pin, the finger being of a predetermined thickness sufficient to maintain engagement with the second pin as the pull shaft slides between the upper position and the lower position; and a key having a handle for grasping, the key having a stem extending from the handle, the stem being configured to releasably engage the lock shaft upper end so as to transmit rotational motion from the key to the lock shaft;

so that, with the latch bar and pull shaft in the latched position, upon turning the key in a first direction, the lock shaft and hook will rotate in the first direction, the finger will move into juxtaposition with the second pin, enclosing the second pin between the finger and the boss slot, thereby preventing rotation of the pull shaft and unlatching of the latch bar, and upon turning the key in a second direction opposite to the first direction, the lock shaft and hook will rotate in the second direction, the finger will move away from the second pin, thereby allowing rotation of the pull shaft and unlatching of the latch bar.

14. A latch for use in connection with a boat hatch having a compression seal and a hatch jamb, the latch comprising:

a housing, the housing having a well extending between opposite upper and lower ends, the well having a floor enclosing the lower end, the housing having a flange extending outward from the well upper end, the flange having a top surface and a bottom surface, the flange bottom surface being adapted for mounting against the boat hatch, the housing having a pocket extending downward from the floor, the housing having a boss extending downward from a proximal end at the floor to a distal end, the boss having an outer periphery, the boss having a vertical central axis, the boss having a vertical bore aligned with the central axis and extending through the boss;

a bushing received in the boss vertical bore, the bushing having a bushing bore;

a pull shaft, the pull shaft extending between opposite upper and lower ends, the pull shaft having a longitudinal axis, the pull shaft having a first hole transversely therethrough adjacent the pull shaft upper end, the pull shaft having a second hole transversely therethrough below the first hole, the pull shaft having a third hole transversely therethrough below the second hole, the pull shaft having an annular O-ring groove disposed between the first and second holes, the pull shaft being mounted in the bushing bore for rotational movement and sliding movement along the vertical central axis between an upper position and a lower position;

a latch bar, the latch bar being mounted on the pull shaft lower end and projecting transversely outward, the latch bar being adapted for engaging the hatch jamb;

an O-ring received in the O-ring groove for slidingly sealing the pull shaft against the bushing bore, so as to prevent water intrusion through the latch;

a handle, the handle having a grasping portion, the handle having two ears extending outward from the grasping portion, the ears having collinear pivot holes transversely therethrough, the handle being pivotally mounted on the pull shaft with the ears straddling the pull shaft upper end and the pivot holes aligned with the pull shaft first hole for pivotal movement from a handle position projecting upward to a handle position lying within the well, the ears each having a cam lobe shape, so as to cause the pull shaft to slide axially in the vertical bore to the lower position as the handle is raised and to the upper position as the handle is lowered, the handle having a dimple, the dimple having a brightly colored pigment therein, the dimple being visible when the handle is lying within the well and the latch is in the unlatched position, so as to clearly indicate, by visual inspection, that the latch in the unlatched position;

a first pin received in the pivot holes and the pull shaft first hole, so as to pivotally mount the handle to the pull shaft upper end;

a second pin received in the pull shaft second hole, the second pin projecting outward on only one side of the pull shaft;

the boss having a slot extending transversely through the boss and through the vertical bore, the slot extending vertically along the central axis from an upper terminal surface to a lower terminal surface, the lower terminal surface being above the boss distal end, the upper and lower terminal surfaces being generally planar and generally perpendicular to the central axis, the upper terminal surface facing downward, the lower terminal surface facing upward, the slot being juxtaposed with the second hole, the distance between the upper terminal surface and the lower terminal surface being sufficient to allow the second pin to travel within the slot between the upper position and the lower position, the slot having a slot wall extending generally vertically between the upper terminal surface and the lower terminal surface, the slot having a transverse depth extending from the boss periphery inward past the central axis to the slot wall, the transverse depth being sufficient to allow the second pin to rotate one half turn before striking the slot wall in either direction, thereby defining a rotation stop;

a latch bar, the latch bar being mounted on the pull shaft lower end and projecting transversely outward, the latch bar being adapted for engaging the hatch jamb; so that the second pin will contact the slot wall at the predetermined rotational position and at a second rotational position approximately one-half turn from the predetermined rotational position, thereby stopping the latch bar in the latched and unlatched positions, respectively;

a third pin received in the pull shaft third hole, the third pin projecting outward on both sides of the pull shaft;

a spring, the spring being a coil spring mounted generally concentrically on the pull shaft, the spring bearing upward on the boss distal end and downward on the third pin, so as to bias the pull shaft downward with respect to the housing, the spring being disposed below the rotation stop, so as to allow inspection, lubrication, and replacement of the spring without removing the pull shaft from the housing;

attaching means for attaching the latch bar on the pull shaft lower end; and fastening means for fastening the latch to the boat hatch;

a lock shaft extending between opposite upper and lower ends, the lock shaft being mounted for rotation in the housing floor with the lower end projecting below the housing floor;

a hook extending between opposite proximal and distal ends, the hook proximal end being attached to the lock shaft lower end, the hook distal end having a finger projecting transversely outward therefrom, the finger being adapted for engagement with the second pin, the finger being of a predetermined thickness sufficient to maintain engagement with the second pin as the pull shaft slides between the upper position and the lower position; and a key having a handle for grasping, the key having a stem extending from the handle, the stem being configured to releasably engage the lock shaft upper end so as to transmit rotational motion from the key to the lock shaft;

so that with the latch bar in an unlatched position, the handle will lie flush with the housing inside the well, and the handle will then be pivoted into an upright position, the cam lobe shaped ears and spring will cause the pull shaft to slide axially downward to the lower position, the handle will then be rotated one-half turn so that the latch bar engages the hatch jamb in a latched position, the handle will be pivoted downward so that the handle will lie flush with the housing inside the well, the cam lobes will cause the pull shaft to slide axially upward to the upper position and thereby raise the shaft and latch bar so as to increase the compression between the hatch and the seal for watertight closure; and so that, with the latch bar and pull shaft in the latched position, upon turning the key in a first direction, the lock shaft and hook will rotate in the first direction, the finger will move into juxtaposition with the second pin, enclosing the second pin between the finger and the boss slot, thereby preventing rotation of the pull shaft and unlatching of the latch bar, and upon turning the key in a second direction opposite to the first direction, the lock shaft and hook will rotate in the second direction, the finger will move away from the second pin, thereby allowing rotation of the pull shaft and unlatching of the latch bar.

15. The latch of claim 14, wherein the attaching means further comprises:

the pull shaft lower end being threaded;

the latch bar having a threaded mounting hole therethrough, the latch bar being mounted on the pull shaft lower end; and a nut threaded onto the pull shaft lower end below the latch bar.

* * * * *

UNITED STATES PATENT AND TRADEMARK OFFICE

CERTIFICATE OF CORRECTION

PATENT NO. : 7,452,010 B2
APPLICATION NO. : 11/281552
DATED : November 18, 2008
INVENTOR(S) : Oren Cotton It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 163 days.

Signed and Sealed this

Twenty-sixth Day of October, 2010

David J. Kappos

David J. Kappos
*Director of the United States Patent and Trademark Office*